US012121951B2

(12) United States Patent
Lauth

(10) Patent No.: US 12,121,951 B2
(45) Date of Patent: Oct. 22, 2024

(54) DEVICE FOR STRETCHING A METAL SEMI-FINISHED PRODUCT IN THE FORM OF INDIVIDUAL PLATES ALONG A STRETCHING SECTION WITH A STRETCHING FRAME, AND METHOD FOR STRETCHING A METAL SEMI-FINISHED PRODUCT USING THE DEVICE

(71) Applicant: SMS group GmbH, Düsseldorf (DE)

(72) Inventor: Stefan Lauth, Mönchengladbach (DE)

(73) Assignee: SMS group GmbH, Düsseldorf (DE)

( * ) Notice: Subject to any disclaimer, the term of this patent is extended or adjusted under 35 U.S.C. 154(b) by 291 days.

(21) Appl. No.: 17/767,649

(22) PCT Filed: Sep. 25, 2020

(86) PCT No.: PCT/EP2020/076926

§ 371 (c)(1),
(2) Date: Apr. 8, 2022

(87) PCT Pub. No.: WO2021/069239

PCT Pub. Date: Apr. 15, 2021

(65) Prior Publication Data

US 2023/0249240 A1 Aug. 10, 2023

(30) Foreign Application Priority Data

Oct. 11, 2019 (DE) ..... 10 2019 215 676.2

(51) Int. Cl.

| | |
|---|---|
| ***B21D 25/04*** | (2006.01) |
| ***B21D 25/00*** | (2006.01) |
| ***B21D 43/08*** | (2006.01) |

(52) U.S. Cl.
CPC ..... *B21D 25/04* (2013.01); *B21D 43/08* (2013.01)

(58) Field of Classification Search
CPC ..... B21D 25/00; B21D 25/04; B21D 43/08; B21D 43/09
See application file for complete search history.

(56) References Cited

U.S. PATENT DOCUMENTS

| | | | |
|---|---|---|---|
| 1,903,638 | A | 4/1933 | Wilfred |
| 4,751,838 | A | 6/1988 | Voges |

(Continued)

FOREIGN PATENT DOCUMENTS

| | | | |
|---|---|---|---|
| CN | 101896294 | A | 11/2010 |
| CN | 102152115 | A | 8/2011 |

(Continued)

OTHER PUBLICATIONS

English translate (CN202683717U), retrieved date Mar. 11, 2024.*

(Continued)

*Primary Examiner* — Mohammed S. Alawadi
(74) *Attorney, Agent, or Firm* — Smartpat PLC

(57) ABSTRACT

A device for stretching a metal semi-finished product in the form of individual plates along a stretching section with a stretching frame (2) includes pressure columns (7, 8) extending in the axial direction of the stretching section. A first clamping head (3) in which a first short side of the semi-finished product to be stretched can be clamped can be axially moved by means of stretching cylinders (5, 6). A second clamping head (4) in which the second short side of the semi-finished product to be stretched can be clamped is provided. At least one axial inlet and one axial outlet of the stretching frame (2) are provided. The clamping heads (3, 4) are designed such that the semi-finished product to be stretched can be guided axially through at least one, preferably through both clamping heads (3, 4).

15 Claims, 1 Drawing Sheet

(56) References Cited

U.S. PATENT DOCUMENTS

| | | | | |
|---|---|---|---|---|
| 6,205,830 | B1 | 3/2001 | Voges | |
| 2002/0104360 | A1 | 8/2002 | Liefer et al. | |
| 2007/0044531 | A1 | 3/2007 | Liefer et al. | |
| 2008/0034827 | A1 | 2/2008 | Casal et al. | |
| 2010/0269559 | A1 | 10/2010 | Ishiguro et al. | |
| 2011/0296898 | A1 | 12/2011 | Echezarreta et al. | |
| 2014/0096582 | A1 | 4/2014 | Buta et al. | |
| 2017/0274439 | A1 * | 9/2017 | Mevissen | B21D 25/04 |

FOREIGN PATENT DOCUMENTS

| | | | | | |
|---|---|---|---|---|---|
| CN | 202683717 | U | * | 1/2013 | |
| CN | 205146987 | U | | 4/2016 | |
| CN | 107350329 | A | | 11/2017 | |
| CN | 109277442 | A | * | 1/2019 | B21D 43/08 |
| DE | 1602551 | A1 | | 3/1971 | |
| DE | 102015214207 | A1 | * | 1/2017 | B21D 25/04 |
| DE | 102015014207 | A1 | | 5/2017 | |
| DE | 102016105306 | A1 | | 9/2017 | |
| EP | 1923150 | B1 | | 1/2010 | |
| EP | 2446979 | B1 | | 4/2015 | |
| FR | 1538250 | A | | 8/1968 | |
| GB | 893001 | A | * | 1/1960 | |
| GB | 907663 | A | | 10/1962 | |
| GB | 1122867 | A | | 8/1968 | |
| JP | S5131665 | A | | 3/1976 | |
| JP | S5272540 | U | | 5/1977 | |
| KR | 20010055198 | A | | 7/2001 | |

OTHER PUBLICATIONS

English translate (DE102015214207A1), retrieved date Mar. 11, 2024.*

English translate (CN109277442A), retrieved date Mar. 12, 2024.*

* cited by examiner

DEVICE FOR STRETCHING A METAL SEMI-FINISHED PRODUCT IN THE FORM OF INDIVIDUAL PLATES ALONG A STRETCHING SECTION WITH A STRETCHING FRAME, AND METHOD FOR STRETCHING A METAL SEMI-FINISHED PRODUCT USING THE DEVICE

TECHNICAL FIELD

The disclosure relates to a device for stretching a metal semi-finished product in the form of individual plates along a stretching section with a stretching frame, comprising pressure columns extending in the axial direction of the stretching section, a first clamping head in which a first short side of the semi-finished product to be stretched can be clamped and which can be axially moved by means of stretching cylinders, and a second clamping head in which the second short side of the semi-finished product to be stretched can be clamped.

The disclosure further relates to a method for stretching a metal semi-finished product in the form of individual plates along a stretching section using the device described above.

BACKGROUND

Plate stretchers along with plate stretching processes of the type described above are known in the prior art, for example from the publications DE 10 2016 105 306 A1 and DE 10 2015 214 207 A1.

As a rule, such plate stretchers have two clamping heads turned towards each other, which can be moved against each other for applying a clamping force directed along a direction of stretching. They are used for stretching and/or straightening rolled or pressed stretching material, in particular for stretching and/or straightening individual sheets or plates that are clamped or wedged, as the case may be, in the clamping heads. Depending on the design of the plate stretcher, both clamping heads can be moved during stretching. However, arrangements are frequently found with which a fixed clamping head and a clamping head that is movable against it are provided. Such an arrangement is known, for example, from DE 10 2015 14 207 A 1, with which the movable clamping head can be moved via hydraulic stretching cylinders and stretching rods, whereas the fixed clamping head comprises a carriage that can be locked relative to pressure column elements of the stretching frame. Locking in different positions is desirable because, in contrast to the quasi-continuous straightening of sheets wound into coils, different workpiece lengths or plate lengths or sheet lengths, as the case may be, are used when stretching individual plates or sheets, and the stretching frame must be adjustable accordingly. Methods and devices for straightening metal sheets wound into coils are known, for example, from EP 1 923 150 B 1 and US 2002/0104360 A1.

Known plate stretchers are loaded and unloaded with plates from above by means of a crane system. The clamping heads must be adjusted beforehand to a dimension larger than the plate to be stretched. The clamping heads then move together and feed the plate to the clamping devices integrated in the clamping heads. For unloading, the clamps are opened after the stretching process and the clamping heads are moved again to a dimension larger than the stretched plate. Such procedure has the disadvantage that a relatively large stroke of the stretching cylinders is required, since the clamping heads must be adjusted to a dimension greater than the length of the plate to be stretched. In addition, the non-productive times of the stretching process are high compared to the time required for stretching. Overall, the required cycle time is relatively long.

SUMMARY

The disclosure is based on the object of providing a plate stretcher of the type mentioned above along with a corresponding method with which the non-productive times are reduced and thus the overall cycle time is optimized.

The object is achieved by a device as disclosed herein. The task underlying the disclosure is further achieved by a method as disclosed herein.

According to one aspect, a device for stretching a metal semi-finished product in the form of individual plates along a stretching section with a stretching frame is provided. The device comprises pressure columns extending in the axial direction of the stretching section, a first clamping head in which a first short side of the semi-finished product to be stretched can be clamped and which can be axially moved by means of stretching cylinders, and a second clamping head in which the second short side of the semi-finished product to be stretched can be clamped. The device (or plate stretcher) is characterized in particular by the fact that at least one axial inlet and one axial outlet of the stretching frame are provided and in that the clamping heads are designed such that the semi-finished product to be stretched can be guided axially through at least one of the clamping heads, preferably through both clamping heads. The plates can therefore be fed and discharged in the direction of the force applied during stretching.

This eliminates the need to load and unload the device from above using a crane. The feeding and discharging of the individual plates can be fully automated. The cycle time required to stretch an individual plate is drastically reduced. In addition, the length of the stretching cylinders is reduced, by which the plate stretcher can have smaller overall dimensions.

Preferably, at least one clamping head has at least one clamping head mouth that is open in the direction of stretching, such that the plate to be stretched can be inserted into the relevant clamping head mouth from the outside in the axial direction. The clamping head mouths are preferably turned away from each other in the stretching frame in the axial direction of the stretching section, and at least one clamping head is designed such that a plate can be guided through the relevant clamping head, such that the plate can be positioned between the clamping heads.

With the plate stretcher according to the disclosure, it can be provided that both clamping heads can be moved during the stretching or elongation, as the case may be, of a plate. Preferably, the second or the first clamping head is provided to be locked or lockable relative to pressure column elements of the stretching frame. For this purpose, the stretching frame can have a locking device that corresponds, for example, to that described in DE 10 2015 214 207 A1.

The clamping heads can have means for clamping and/or wedging, as the case may be, the workpiece or plate in a known manner.

It is expedient that the axial inlet comprises an inlet roller conveyor and the axial outlet comprises an outlet roller conveyor. The inlet roller conveyor and/or the outlet roller conveyor can comprise driven rollers, such that the inlet of the plate and the outlet of the plate can be accomplished in the axial direction of the stretching section.

Preferably, the inlet roller conveyor and/or the outlet roller conveyor are adjustable in height in order to be able to position the plate at the average height level of the plate stretcher or the stretching plane, as the case may be, during loading or unloading. Typically, the plates to be stretched are provided on roller conveyors standing above the floor. The inlet roller conveyor can take over the plate to be stretched at the height level at which it is provided. The inlet roller conveyor is then brought up to the relevant clamping head and adjusted to the appropriate height level. In a similar manner, the stretched plate is transported away by means of the outlet roller conveyor.

Preferably, first and second loading devices are provided, wherein the first loading device is arranged on the first clamping head and the second loading device is arranged on the second clamping head, wherein each of the loading devices comprises driven rollers. The loading devices enable the positioning the plate to be stretched in height, the centering of the plate in the longitudinal axis and the driving of the plate.

Preferably, the plate is conveyed from below by means of driven rollers and with pressure rollers acting from above. Each of the loading devices can have a centering unit. These can be designed, for example, in accordance with the manner described in DE 10 2016 105 306 A1, which is hereby incorporated by reference in its entirety.

In an advantageous variant of the device, it is provided that at least one transverse straightening press is provided between the first and the second clamping head. The transverse straightening press can be designed to apply a force to the plate that is perpendicular to the clamping force or stretching force, as the case may be. This allows the relevant plate to be straightened transversely during stretching, such that the buckling of the plate during stretching is prevented. Preferably, a plurality of movable transverse straightening presses is provided, which presses can be moved along in the direction of stretching of the plate during stretching.

Alternatively or additionally, a centering device can be provided on at least one transverse straightening press, which takes over the centering of the plate when it is fed to the second clamping head.

The task underlying the disclosure is further achieved by a method for stretching a metal semi-finished product in the form of individual plates along a stretching section using the above-described plate stretcher. The method is characterized by the following procedural steps:

- Feeding an individual plate with its first short side in the axial direction of the stretching section to the first clamping head,
- Guiding the plate through the first clamping head and feeding the plate with the first short side to the second clamping head in the axial direction of the stretching section,
- Fixing the plate in the first and the second clamping head,
- Stretching the plate with a predetermined stroke to a predetermined length and
- Conveying the stretched plate in the axial direction of the stretching section through the second clamping head.

Guiding the plate through the first clamping head and feeding the plate to the second clamping head, along with conveying the stretched plate through the second clamping head, can be accomplished by means of the first and second loading devices.

It is expedient to straighten the sheet transversely during stretching by means of at least one transverse straightening press, i.e. transversely to the axial extension or transversely to the stretching force acting in the axial direction, as the case may be. At least one transverse straightening press can be moved along in the direction of stretching of the plate during stretching.

Preferably, the plate is automatically positioned in a predetermined position within the stretching frame by means of at least one position measuring system before being fixed in the clamping heads by means of the first and/or the second loading device. For example, photoelectric sensors can be installed in the clamping heads to detect the position of the plate. With the position information thus obtained, the drive of the loading device can position the plate precisely within the stretching frame.

BRIEF DESCRIPTION OF THE DRAWINGS

The invention is explained below with reference to the accompanying drawings by way of an exemplary embodiment.

DETAILED DESCRIPTION

Figure 1:
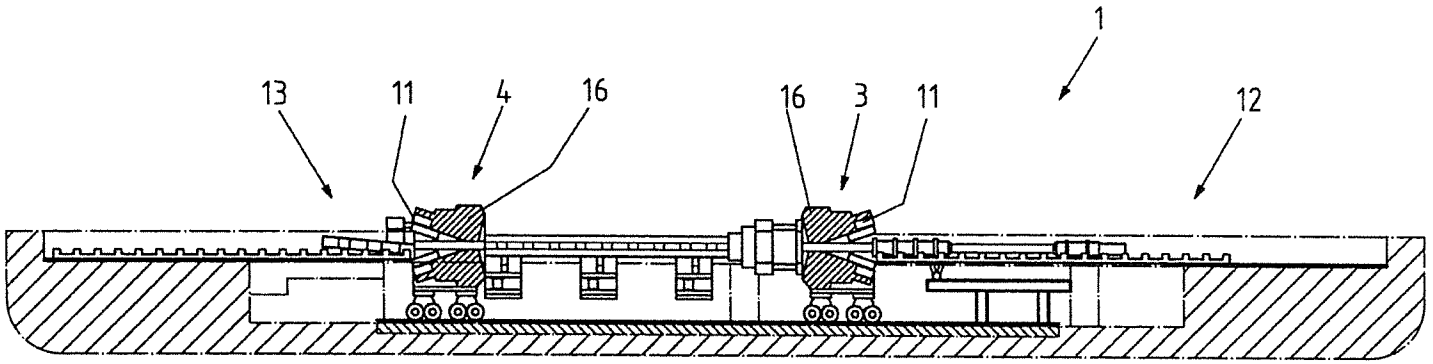
FIG. 1 is a side view of a plate stretcher.
Figure 2:
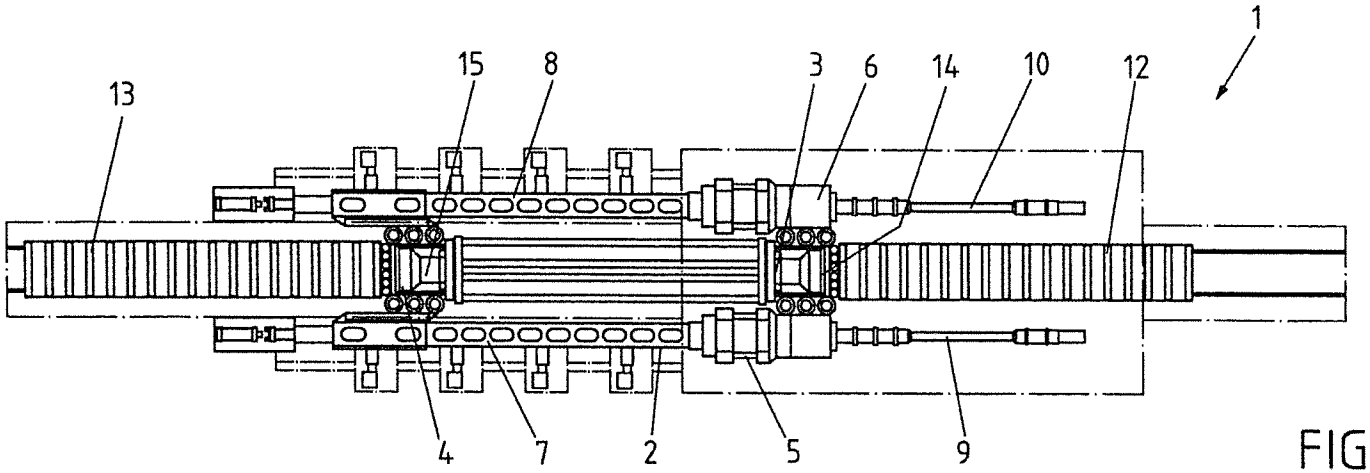
FIG. 2 is a top view of the plate stretcher according to FIG. 1.

The plate stretcher 1 comprises a stretching frame 2 with a first and a second clamping head 3, 4 movable within the stretching frame 2. The stretching frame 2 comprises a first and a second stretching cylinder 5, 6, wherein the first stretching cylinder is supported on a first pressure column 7 and the second stretching cylinder 6 is supported on a second pressure column 8. The first and second pressure columns 7, 8 respectively form the abutment for first and second stretching rods 9, 10 of the first and second stretching cylinders 5, 6. The first and second stretching rods 9, 10 are each arranged in alignment with the first and second pressure columns 7, 8 and form the stretching frame 2. The first clamping head can be moved along the stretching rods 9, 10 by means of the stretching cylinders 5, 6. A hydraulic drive is used to apply a pressure medium to the stretching cylinders 5, 6, causing a movement of the first clamping head 3 in the axial direction of the stretching section formed by the stretching frame 2 relative to the second clamping head 4. With the described exemplary embodiment, the second clamping head 4 is locked relative to the pressure columns 7, 8; i.e., it is fixed, whereas the first clamping head 3 is movable relative to the second clamping head 4.

Each of the clamping heads 3, 4 has a clamping head mouth 11. The clamping head mouths are turned away from each other inside the stretching frame 2. The clamping head mouth 11 of the first clamping head 3 is open in the direction of an inlet roller conveyor 12, the clamping head mouth 11 of the second clamping head 4 is open in the direction of an outlet roller conveyor 13. Each of the clamping heads 3, 4 comprises clamping jaws 16, which wedge the plate in the direction of stretching and which can be opened to allow the plate or the semi-finished product, as the case may be, to be guided through. Both the inlet roller conveyor 12 and the outlet roller conveyor 13 comprise driven rollers.

A first loading device 14 is assigned to the first clamping head 3, which loading device is arranged on the side turned towards the clamping head mouth 11, whereas a second loading device 15 is assigned to the second clamping head 4, which loading device is arranged on the side turned away from the clamping head mouth 11. The loading devices 14, 15 comprise driven rollers and effect a positioning and centering of the plate within the stretching frame 2.

A plate, not shown in the drawings, is fed to the stretching frame 2 from the right via the inlet roller conveyor 12. This plate is then taken over by the first loading device 14 and guided through the clamping head mouth 11 of the first clamping head 3, centered accordingly. A first short side of the plate (short side leading in the conveying direction) is fed to the second clamping head 4, where it is inserted and fixed. The second short side of the plate (short side lagging in the conveying direction) is or will be fixed in the first clamping head 3. Thereupon, the first clamping head 3 is moved relative to the second clamping head 4, whereby the plate is stretched between the first and second clamping heads 3, 4. After completion of the stretching process, the clamping or wedging, as the case may be, of the plate is released and the plate is conveyed further through the second clamping head 4 onto the outlet roller conveyor 13. Immediately after this, an additional plate can be loaded via the inlet roller conveyor 12.

LIST OF REFERENCE SIGNS

1 Plate stretcher
2 Stretching frame
3 First clamping head
4 Second clamping head
5 First stretching cylinder
6 Second stretching cylinder
7 First pressure column
8 Second pressure column
9 First stretching rod
10 Second stretching rod
11 Clamping head mouth
12 Inlet roller conveyor
13 Outlet roller conveyor
14 First loading device
15 Second loading device
16 Clamping jaws

The invention claimed is:

1. A device for stretching a semi-finished metal plate along a stretching section, comprising:

a stretching frame (2), comprising a first pressure column (7) and a second pressure column (8) extending in an axial direction of the stretching section, a first stretching cylinder (5) supported on the first pressure column (7), a second stretching cylinder (6) supported on the second pressure column (8), a first stretching rod (9) aligned with the first pressure column (7), the first pressure column (7) forming an abutment for the first stretching rod (9), and a second stretching rod (10) aligned with the second pressure column (8), the second pressure column (8) forming an abutment for the second stretching rod (10);

a first clamping head (3) in which a first short side of the semi-finished metal plate to be stretched can be clamped, the first clamping head (3) being axially movable within the stretching frame (2) by the first stretching cylinder (5) and the second stretching cylinder (6);

a first loading device (14) assigned to the first clamping head (13);

a second clamping head (4) in which a second short side of the semi-finished metal plate to be stretched can be clamped;

a second loading device (15) assigned to the second clamping head (4); and an axial inlet and an axial outlet of the stretching frame (2), wherein the first clamping head (3) and/or the second clamping head (4) is designed such that the semi-finished metal plate to be stretched can be guided axially through the first clamping head (3) and/or the second clamping head (4), and wherein the first clamping head (3) and/or the second clamping head (4) comprises a sensor for detecting a position of the semi-finished metal plate, wherein the first loading device (14) and the second loading device (15) each comprise driven rollers, and wherein the driven rollers position the plate in the stretching frame based on the position of the plate detected by the sensor.

2. The device according to claim 1, wherein the axial inlet comprises an inlet roller conveyor (12) and wherein the axial outlet comprises an outlet roller conveyor (13).

3. The device according to claim 2, wherein the inlet roller conveyor (12) and/or the outlet roller conveyor (13) comprise driven rollers.

4. The device according to claim 2, wherein the inlet roller conveyor (12) and/or the outlet roller conveyor (13) is adjustable in height.

5. The device according to claim 1, further comprising a first loading device (14) assigned to the first clamping head (13) and a second loading device (15) assigned to the second clamping head (4).

6. The device according to claim 5, wherein the first loading device (14) and the second loading device (15) each comprise driven rollers.

7. The device according to claim 5, wherein the first loading device (14) and the second loading device (15) each comprise a centering unit.

8. The device according to claim 1, wherein at least one transverse straightening press is provided between the first clamping head (3) and the second clamping head (4).

9. The device according to claim 1, wherein the first clamping head (3) comprises the sensor for detecting a position of the plate, and wherein the second clamping head (4) comprises a further sensor for detecting the position of the plate.

10. The device according to claim 1, wherein the sensor is a photoelectric sensor.

11. A method for stretching a semi-finished metal plate along a stretching section, comprising:

providing a stretching frame, including a first pressure column and a second pressure column extending in an axial direction of the stretching section, a first stretching cylinder supported on the first pressure column, a second stretching cylinder supported on the second pressure column, a first stretching rod aligned with the first pressure column, the first pressure column forming an abutment for the first stretching rod, and a second stretching rod aligned with the second pressure column, the second pressure column forming an abutment for the second stretching rod, a first clamping head, the first clamping head being axially movable within the stretching frame by the first stretching cylinder and the second stretching cylinder, a first loading device with driven rollers assigned to the first clamping head, a second clamping head, and a second loading device with driven rollers assigned to the second clamping head, wherein the first clamping head and/or the second clamping head comprises a sensor for detecting a position of the plate;

feeding the plate from an axial inlet with a second short side in the axial direction of the stretching section to the first clamping head;

guiding the plate through the first clamping head and feeding the second short side of the plate to the second clamping head in the axial direction of the stretching section;

positioning the plate in the stretching frame with the driven rollers based on position information detected by the sensor;

fixing the plate in the first clamping head and the second clamping head;

stretching the plate with a predetermined stroke to a predetermined length to produce a stretched plate; and conveying the stretched plate in the axial direction of the stretching section through the second clamping head to an axial outlet.

12. The method according to claim 11, wherein guiding the plate through the first clamping head and feeding the plate with the second short side to the second clamping head, along with conveying the stretched plate through the second clamping head, is performed by a first loading device assigned to the first clamping head and by a second loading device assigned to the second clamping head.

13. The method according to claim 12, wherein the plate is transversely straightened during stretching.

14. The method according to claim 11, wherein at least one transverse straightening press is moved along in a stretching direction of the plate during stretching.

15. The method according to claim 12, wherein the plate is automatically positioned in a predetermined position within the stretching frame by at least one position measuring system before being fixed in the first clamping head and the second clamping head by the first loading device and/or the second loading device.

* * * * *